US011067326B2

(12) United States Patent
Miller

(10) Patent No.: US 11,067,326 B2
(45) Date of Patent: Jul. 20, 2021

(54) ICE DISPENSING ASSEMBLIES AND METHODS FOR PREVENTING CLUMPING

(71) Applicant: Haier US Appliance Solutions, Inc., Wilmington, DE (US)

(72) Inventor: Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 187 days.

(21) Appl. No.: 16/504,637

(22) Filed: Jul. 8, 2019

(65) Prior Publication Data

US 2021/0010734 A1 Jan. 14, 2021

(51) Int. Cl.
*F25C 5/20* (2018.01)
*F25C 5/182* (2018.01)

(52) U.S. Cl.
CPC ..... *F25C 5/22* (2018.01); *F25C 5/182* (2013.01); *F25C 2500/08* (2013.01)

(58) Field of Classification Search
CPC ..... F25C 5/22; F25C 5/182; F25C 2500/08; F25C 5/24; F25C 5/04; F25C 2300/00; F25C 5/00; F25C 5/20; F25C 5/14; F25C 5/046; F25C 5/02; F25C 2305/00; F25C 2305/022
USPC ..... 62/342, 343, 320
See application file for complete search history.

(56) References Cited

U.S. PATENT DOCUMENTS

| | | | | |
|---|---|---|---|---|
| 3,572,053 | A | 3/1971 | Jacobus et al. | |
| 3,940,116 | A * | 2/1976 | Verlinden | B01F 7/00175 366/279 |
| 4,176,527 | A * | 12/1979 | Linstromberg | F25C 5/046 222/240 |
| 6,257,009 | B1 * | 7/2001 | Tsuchikawa | F25C 1/147 62/233 |
| 7,575,185 | B2 | 8/2009 | Hammonds et al. | |
| 8,387,408 | B2 | 3/2013 | Kim et al. | |
| 8,826,683 | B2 | 9/2014 | Nuss | |
| 2004/0261442 | A1 * | 12/2004 | Chung | F25C 5/046 62/344 |
| 2006/0207270 | A1 * | 9/2006 | Voglewede | F25C 5/22 62/135 |
| 2010/0193546 | A1 * | 8/2010 | Jennison | F25C 5/20 222/167 |

(Continued)

*Primary Examiner* — Frantz F Jules
*Assistant Examiner* — Evan J. Cusick
(74) *Attorney, Agent, or Firm* — Dority & Manning, P. A.

(57) ABSTRACT

An ice dispensing assembly, as provided herein, may include a container, a rotatable drum, a motor, an agitator bridge, and a rotatable blade. The container may define an opening for passing ice. The rotatable may be positioned below the container. The rotatable drum may define an inner channel from a first arc point to a second arc point. The rotatable blade may be housed within the rotatable drum between the first arc point and the second arc point. The rotatable drum may be movable between a crusher position and an agitator position. The crusher position may include the rotatable blade in engagement with the rotatable drum at the first arc point while being circumferentially spaced apart from the second arc point. The agitator position may include the rotatable blade in engagement with the rotatable drum at the second arc point while being circumferentially spaced apart from the first arc point.

18 Claims, 10 Drawing Sheets

(56) References Cited

U.S. PATENT DOCUMENTS

| | | | | |
|---|---|---|---|---|
| 2012/0036881 | A1* | 2/2012 | Lawson | F25C 5/22 62/320 |
| 2012/0125017 | A1* | 5/2012 | Talegaonkar | F25C 5/22 62/56 |
| 2012/0186276 | A1* | 7/2012 | Seymour | G07F 17/0071 62/66 |
| 2013/0305763 | A1* | 11/2013 | Nuss | F25C 5/12 62/320 |
| 2013/0312448 | A1* | 11/2013 | Schukar | B01F 11/0082 62/340 |
| 2015/0338147 | A1* | 11/2015 | Bauriedl | F25C 5/22 49/324 |
| 2016/0201967 | A1* | 7/2016 | Mitchell | F25C 5/22 62/135 |
| 2016/0216021 | A1* | 7/2016 | Kang | F25C 5/22 |
| 2017/0268813 | A1* | 9/2017 | Abbas | B65G 65/40 |
| 2017/0292751 | A1* | 10/2017 | Lee | F25C 5/182 |
| 2017/0292754 | A1* | 10/2017 | Yang | F25C 5/182 |
| 2018/0149398 | A1* | 5/2018 | Jeong | F25D 23/062 |

* cited by examiner

ICE DISPENSING ASSEMBLIES AND METHODS FOR PREVENTING CLUMPING

FIELD OF THE INVENTION

The present subject matter relates generally to ice dispensing assemblies, such as for a refrigerator appliance, and more particularly to ice dispensing assemblies and methods to prevent ice from clumping prior to being dispensed.

BACKGROUND OF THE INVENTION

Generally, a refrigerator includes a freezer compartment and a fresh food compartment, which are partitioned from each other to store various foods at appropriate low temperatures. It is common to provide an automatic ice maker/water dispenser with a refrigerator. In a "side-by-side" type of refrigerator where the freezer compartment is arranged to the side of the fresh food compartment, the ice maker is usually disposed in the freezer compartment and, thus, utilizes the cold air in the freezer compartment, which may include an evaporator also disposed in the freezer compartment.

In a "bottom freezer" type of refrigerator where the freezer compartment is arranged beneath a top mounted fresh food compartment, convenience necessitates that the ice maker is disposed in a sub-compartment (often referred to as an "icebox") that is usually thermally insulated and configured in one of the top mounted fresh food compartment doors with ice delivered through an opening on the door. In such an arrangement, provision must be made for providing adequate refrigeration to the icebox to enable the ice maker to form and store the ice. An access door is commonly provided on the icebox to allow the consumer to access the internal ice bucket and ice maker.

Typically, the ice maker delivers ice into a storage container or bucket where the ice is kept until needed or desired (e.g., by a user). A panel on the front of the refrigerator may allow the user to select between the dispensing of crushed ice or non-crushed ice. Conventionally, the ice is pushed by an auger through a chute or channel equipped with a one or more blades, which are carried on a shaft and rotate with the shaft to contact and crush the ice. Chilled water can also be provided by routing a thermally conductive conduit to the panel such that the water is cooled before reaching the dispenser.

A common issue for ice making and delivery systems is the clumping of ice within, for example, the storage container. Often, ice will sublimate within the storage container. As touching ice pieces sublimate, they become bonded together. Once bonded, the ice dispensing assembly may be unable to dispense ice. A user may have to discard the entire clumped mass, which can be difficult and wasteful. The sublimation and bonding (i.e., clumping) of ice is especially likely if an extended period of time (e.g., several hours) passes between ice dispensing actions. Such extended periods of time often occur during normal use since typical users do not require ice at short, regular intervals.

The ice container and dispenser can consume a significant amount of space from the freezer or fresh food compartment. Space is consumed not only by the volume required for ice creation and storage, but the mechanisms for moving or crushing the ice can also consume space the user might otherwise prefer to have available for food storage. Additionally, the volume or space for storing ice may be limited by clumped ice, which will often form as an inefficiently-shaped mass that will prevent continued activation/operation of the ice maker. For example, ice often piles in the storage container below an ice maker drop point. When the ice reaches a certain cutoff level, the ice maker detects a full bucket and shuts off. Clumped ice will often reach the cutoff level before efficiently-packed non-clumped ice.

Accordingly, an improved ice dispensing assembly for a refrigerator appliance would be useful. More particularly, an ice dispensing assembly for a refrigerator appliance that could preventing sublimation or clumping of ice within a storage container can be beneficial as it could provide a more efficient and easier-to-use system. Additionally, such a system that can accommodate a greater volume of ice could be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice dispensing assembly is provided. The ice dispensing assembly may include a container, a rotatable drum, a motor, an agitator bridge, and a rotatable blade. The container may have a bottom defining an opening for passing ice from the container. The rotatable drum may define a central axis and be positioned below the container at the opening defined by the bottom of the container. The rotatable drum may have a wall. The rotatable drum may define an inner channel extending circumferentially along an inner surface of the wall from a first arc point to a second arc point. The motor may be in mechanical communication with the rotatable drum and configured to selectively cause the rotatable drum to rotate about the central axis. The agitator bridge may extend above the wall in rotational engagement with the rotatable drum. The rotatable blade may be housed within the rotatable drum below the agitator bridge. The rotatable blade may be in selective rotational engagement with the rotatable drum. The rotatable blade may be circumferentially bounded by the first arc point and the second arc point. The rotatable drum may be movable between a crusher position and an agitator position. The crusher position may include the rotatable blade in engagement with the rotatable drum at the first arc point while being circumferentially spaced apart from the second arc point. The agitator position may include the rotatable blade in engagement with the rotatable drum at the second arc point while being circumferentially spaced apart from the first arc point.

In another exemplary aspect of the present disclosure, a method of operating an ice dispensing assembly. The method may include determining a clumping condition within a container of the ice dispensing assembly. The method may also include directing a motor to rotate a rotatable drum of the ice dispensing assembly on a limited path between a crusher position and an agitator position in response to determining the clumping condition. The crusher position may include the rotatable blade in engagement with the rotatable drum at the first arc point while being circumferentially spaced apart from the second arc point. The agitator position may include the rotatable blade in engagement with the rotatable drum at the second arc point while being circumferentially spaced apart from the first arc point.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
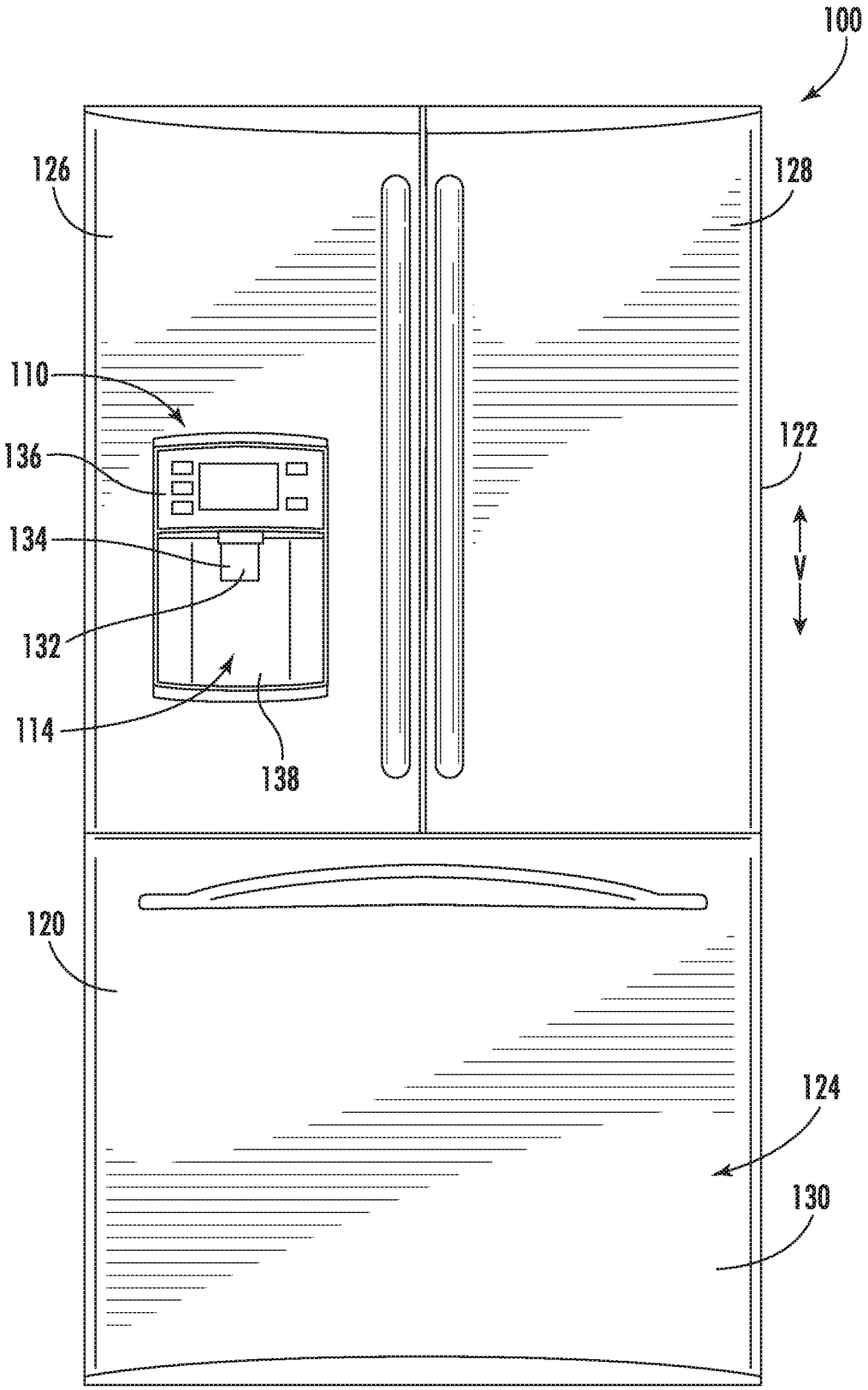
FIG. 1 provides a front elevation view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The term "or" is generally intended to be inclusive (i.e., "A or B" is intended to mean "A or B or both," except as otherwise indicated).

Turning now to the figures, FIG. 1 provides a front elevation view of a refrigerator 100 including a dispensing assembly (e.g., ice dispensing assembly 110) for dispensing water or ice. In this exemplary embodiment, ice dispensing assembly 110 includes a dispenser 114 positioned or disposed on an exterior portion of refrigerator 100. Refrigerator 100 includes a housing 120 defining an upper fresh food compartment 122 and a lower freezer compartment 124 arranged at the bottom of refrigerator 100. As such, refrigerator 100 is generally referred to as a bottom mount refrigerator. In the exemplary embodiment, housing 120 also defines a mechanical compartment (not shown) for receipt of a sealed cooling system. Although described in the context of a bottom mount refrigerator, it is recognized that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 126, 128 are rotatably hinged to an edge of housing 120 for accessing fresh food compartment 122. A freezer door 130 is arranged below refrigerator doors 126, 128 for accessing freezer compartment 124. In the exemplary embodiment, freezer door 130 is coupled to a freezer drawer (not shown) slidably coupled within freezer compartment 124.

In certain embodiments, dispenser 114 includes a discharging outlet 132 for accessing ice and water. A single paddle 134 may be mounted below discharging outlet 132 for operating dispenser 114. A user interface panel 136 may be provided for controlling the mode of operation. For example, user interface panel 136 includes a water dispensing button (not labeled) and an ice dispensing button (not labeled) for selecting a desired mode of operation such as crushed or non-crushed ice.

Discharging outlet 132 and paddle 134 are an external part of dispenser 114, and are mounted in a concave portion 138 defined in an outside surface of refrigerator door 126. Concave portion 138 is positioned or defined at a predetermined elevation convenient for a user to access ice or water enabling the user to access ice without the need to bend-over and without the need to access freezer compartment 124. In the exemplary embodiment, concave portion 138 is positioned or defined at a level that approximates the chest level of a user.

Figure 2:
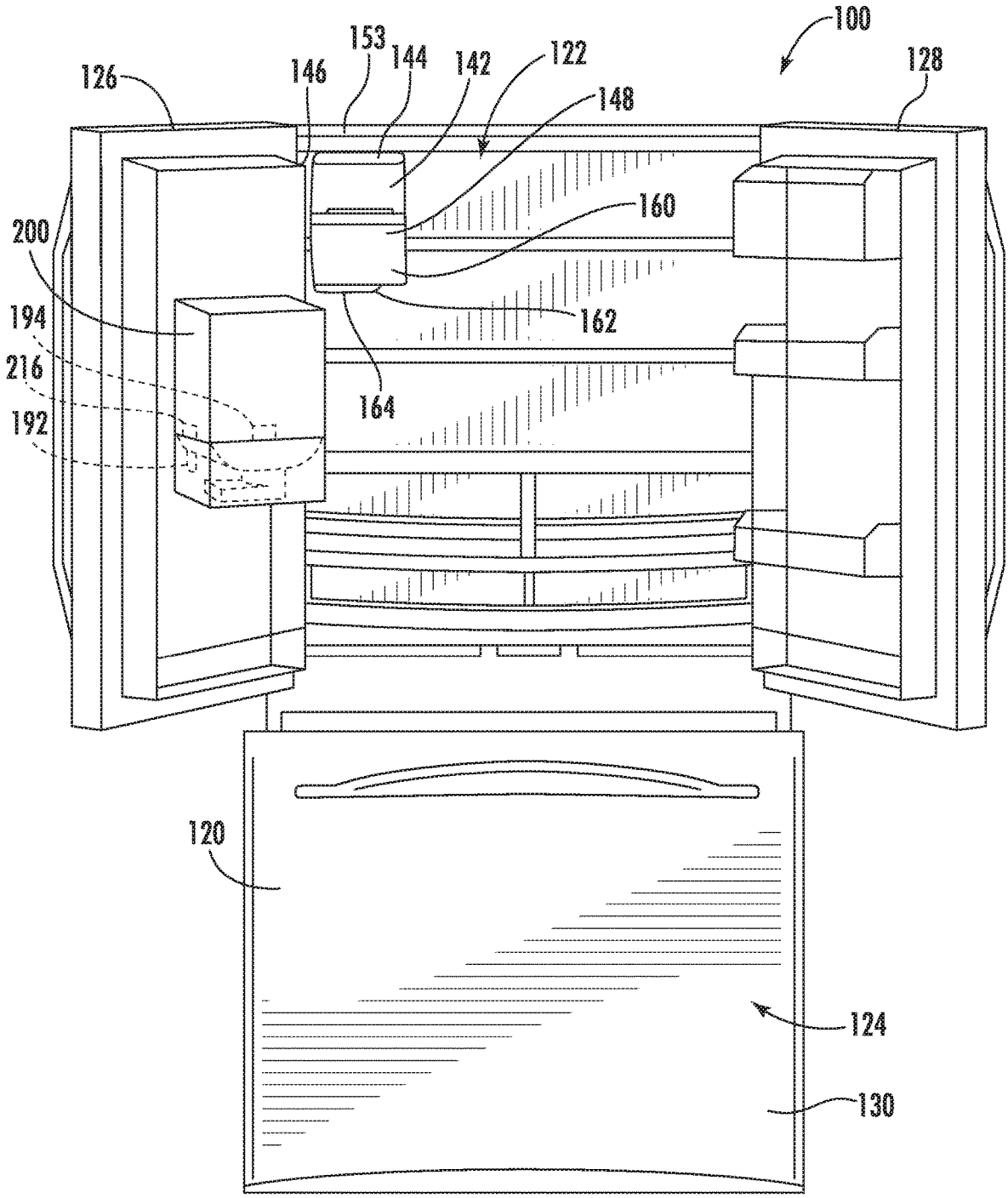
FIG. 2 provides a front elevation view of the exemplary refrigerator appliance of FIG. 1 with doors to the fresh food compartment shown in an open position.

FIG. 2 provides an elevation view of refrigerator 100 having doors 126, 128 in an open position to reveal the interior of the fresh food compartment 122. As such, certain components of this exemplary embodiment of the ice dispensing assembly 110 are illustrated. Dispensing assembly 110 includes an insulated housing 142 mounted within refrigerator compartment 122 along an upper surface 144 of compartment 122 and along a sidewall 146 of compartment 122. Insulated housing 142 includes insulated walls 148 defining an insulated cavity (not shown). Due to the insulation which encloses the cavity, the temperature within the cavity can be maintained at levels different from the ambient temperature in the surrounding fresh food compartment 122.

In some embodiments, the insulated cavity is constructed and arranged to operate at a temperature that facilitates producing and storing ice. More particularly, the insulated cavity contains an ice maker for creating ice and feeding the same to a container 200 that is mounted on refrigerator door 126. As illustrated in FIG. 2, container 200 is placed at a vertical position on refrigerator door 126 that will allow for the receipt of ice from a discharge opening 162 located along a bottom edge 164 of insulated housing 142. As door 126 is closed or opened, housing 200 is moved in and out of position under insulated housing 142. Alternatively, in another exemplary embodiment of the present invention, insulated housing 142 and its ice maker can be positioned or disposed directly on door 126. In still another embodiment of the present invention, in a configuration where the fresh food compartment and the freezer compartment are located side by side (as opposed to over and under as shown in FIGS. 1 and 2), the ice maker could be located on the door for the freezer compartment and directly over container 200. As such, the use of an insulated housing would be unnecessary. Other configurations for the location of ice container 200, an ice maker, or insulated housing 142 may be used as well.

Operation of the refrigerator appliance 100, including a motor 216 of dispensing assembly 110, can be regulated by a controller 190 that is operatively coupled to (e.g., in electrical communication with), for instance user interface panel 136 or various other components. User interface panel 136 provides selections for user manipulation of the operation of refrigerator appliance 100 such as, for example, selections between whole or crushed ice, chilled water, or other options as well. In response to user manipulation of user interface panel 136 or one or more sensor signals, controller 190 may operate various components of the refrigerator appliance 100. controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

The controller 190 may be disposed in a variety of locations throughout refrigerator appliance 100. In the illustrated embodiment, the controller 190 may be located within the control panel area of door 126. In such an embodiment, input/output ("I/O") signals may be routed between the controller 190 and various operational components of refrigerator appliance 100 such as the motor 216 or sensor(s) 192, 194, as will be described further below. In some embodiments, the user interface panel 136 may represent a general purpose I/O ("GPIO") device or functional block. In additional or alternative embodiments, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 190 via one or more signal lines or shared communication busses.

As illustrated, controller 190 may be in communication with the various components of dispensing assembly 110, including motor 216, and may control operation of the various components. For example, the various valves, switches, etc. may be actuatable based on commands from the controller 190. Thus, the various operations may occur based on user input or automatically through controller 190 instruction. In some such embodiments, controller 190 is configured to initiate an ice treatment cycle that advantageously prevents or mitigates clumping of ice within storage container 200.

In optional embodiments, a water sensor 192 (e.g., conductivity sensor or any other suitable sensor configured to detect melted liquid water) is mounted within dispensing assembly 110 in operative (e.g., electrical or wireless) communication with controller 190. For instance, water sensor 192 may be mounted on or within a bottom portion of storage container 200. Optionally, a recess may be formed in which a predetermined volume of liquid water may collect. In response to collection of the predetermined volume of liquid water, water sensor 192 may transmit a corresponding signal (e.g., to controller 190).

In additional or alternative embodiments, a temperature sensor 194 (e.g., thermistor, thermocouple, or any other suitable sensor configured to detect temperature) is mounted within dispensing assembly 110 in operative (e.g., electrical or wireless) communication with controller 190. For instance, temperature sensor 194 may be mounted on or adjacent to storage container 200 (e.g., within insulated housing 142). Based on a temperature detected at housing 142, temperature sensor 194 may transmit a corresponding signal (e.g., to controller 190).

Turning now especially to FIGS. 3 through 8, various views are provided of exemplary embodiments including the ice storage container 200 and an ice crushing mechanism as may be used with ice dispensing assembly 110. For purposes of revealing certain interior components, a portion of the storage container 200 or a cover 238 is/are absent from some figures.

Generally, container 200 has a bottom 202 that defines an opening 204 whereby ice may pass from container 200 and into a drum or rotatable cylinder 206. In some embodiments, bottom 202 includes sloped walls 234 and 236 that help direct ice towards opening 204. As shown, drum 206 is positioned or disposed below container 200 and at opening 204.

In some embodiments, drum 206 has an outer cylindrical wall 208 and defines an inner diameter D at an inner surface of the wall 208. The inner surface 208 may generally face a central axis X, which inner diameter D extends across (e.g., perpendicular to).

One or more rotatable blades 210 are housed within the drum 206 (e.g., radially inward from wall 208). In certain embodiments, rotatable blades 210 extend along at least a portion of diameter D. As will be further described, rotatable blades 210 may selectively rotate with drum 206 as it rotates about the central axis X located in middle of drum 206. In exemplary embodiments, a pin 212 extends along the central axis X within drum 206. Optionally, the pin 212 may be rotationally fixed (e.g., non-rotatable with drum 206). The rotatable blade or blades 210 may be rotatably attached to pin 212. In some such embodiments, the rotatable blade 210 defines an opening through which the pin 212 extends such that blades 210 can freely rotate about pin 212 in either a clockwise or counterclockwise circumferential direction. As best viewed in FIGS. 3 and 7, a housing 220 extends from the bottom 202 of container 200. Housing 220 at least partially encloses rotatable drum 206, and a portion of pin 212 extends into housing 220.

In certain embodiments, one or more non-rotatable or stationary blades 214 are housed within the drum 206. When assembled, the stationary blades 214 may be rotationally fixed such that the stationary blades 214 are non-rotatable about the central axis X. For instance, stationary blades 214 may be attached to pin 212 and not directly connected to the wall 208 of drum 206. As the pin 212 is not rotatable, stationary blades 214 are also not rotatable within drum 206. Stationary blades 214 may thus remain in a fixed position as rotatable blades 210 move about central axis X and relative to stationary blades 214.

As shown, the blades 210 may include a cutting edge 244 having, for example, a plurality of teeth. Specifically, the plurality of teeth of the cutting edge 244 may be formed on one circumferential edge (e.g., the clockwise-facing edge) of each blade 210. In some such embodiments, a flat edge 246 (e.g., planar edge extending parallel to the diameter D) is provided on the opposite circumferential edge (e.g., the counterclockwise-facing edge) of each blade 210.

In certain embodiments, blades 210 and 214 each have cutting edges 244 and 248 that are oriented towards each other. As such, from the perspective of FIGS. 3 and 6, when drum 206 is rotated in a clockwise circumferential direction, cutting edges 244 and 248 are moved towards each other to crush ice that has fallen into a position between blades 210 and 214. Conversely, when drum 206 is rotated in a counterclockwise circumferential direction, cutting edges 244 and 248 move away from each other such that non-crushed or whole ice passes vertically under the force of gravity through drum 206.

The wall 208 of drum 206 has a top end 224 and a bottom end 226. The blades 210, 214 are housed between the top end 224 and the bottom end 226. As shown, one or more agitator bridges 230A, 230B extend, at least in part, above the top end 224 of wall 208. Thus, the blades 210, 214 are housed, at least in part, below each agitator bridge 230A or 230B. Moreover, the agitator bridges 230A, 230B extend generally upward into the storage container 200. When assembled, the agitator bridge 230A or 230B may be rotationally engaged with the drum 206 or wall 208. Rotation of the drum 206 may thus be transferred (e.g., selectively) to the agitator bridges 230A, 230B. Although two agitator bridges 230A, 230B are shown, one or more agitator bridges may be used with the present invention and may located in different locations on top end 224. As will be described below, the agitator bridges 230A, 230B may be selectively rotated within the storage container 200 while contacting ice and thereby "fluidize" the same so that the ice may be agitated, prevented from sublimating, or permitted to more readily flow into drum 206.

In certain embodiments, one or more of the agitator bridges 230A, 230B includes an upper body 250 disposed above the top end 224. Optionally, the upper body 250 may extend to the pin 212 from the top end 224. As shown, the upper body 250 may generally extend from the top end 224 both vertically upward and radially inward (i.e., toward the central axis X). In some embodiments, the agitator bridge 230A or 230B is rotatably attached to the pin 212 and is selectively rotatably about the central axis X.

In additional or alternative embodiments, the agitator bridge 230A or 230B includes an internal tab 252 252 (e.g., first internal tab) that extends axially (e.g., parallel to the central axis X) along an inner surface (e.g., inner surface 242) of the drum 206 or wall 208. The internal tab 252 may extend axially downward at the top end 224 (e.g., downward from the upper body 250). In certain embodiments, the internal tab 252 is rotationally fixed to the rotatable drum 206 (e.g., by one or more adhesives, mechanical fasteners, etc.). The rotatable drum 206 and internal tab 252 (as well as the rest of the agitator bridge 230A or 230B) may thus rotate in tandem.

In embodiments wherein multiple agitator bridges 230A, 230B are provided. Two or more of the agitator bridges 230A, 230B (e.g., a first agitator bridge 230A and a second agitator bridge 230B) may be circumferentially spaced apart from each other (e.g., by more than 15°, such as between 15° and 180°). For instance, the internal tab 252 of a first agitator bridge 230A may be circumferentially spaced from the internal tab 252 of a second agitator bridge 230B such that each of the internal tabs 252 are located at discrete (e.g., parallel) locations about the central axis X.

As shown, the rotatable drum 206 defines one or more inner channels 254 that extend circumferentially about the central axis X. Specifically, each inner channel 254 may extend along the inner surface 242 of the wall 208 from a corresponding first arc point 260 to a corresponding second arc point 262. For instance, an inner channel 254 may define an inward-facing groove that extends radially outward from another portion of the drum 206 or internal tab 252. In some such embodiments, the inner channel 254 provides a gap that is defined radially outward from the innermost surface of the internal tab 252 and, for example, circumferentially outward from the internal tab 252. Optionally, the internal tab 252 may define the second arc point 262.

One or more of the rotatable blades 210 may extend to and be positioned within a corresponding inner channel 254. Thus, at least a portion of the rotatable blade 210 may be bounded (e.g., circumferentially bounded) by the first arc point 260 and the second arc point 262. For instance, an endcap 256 of each rotatable blade 210 may be disposed within a separate corresponding inner channel 254. Between the first arc point 260 and the second arc point 262, the rotatable blade 210 may move freely relative to the drum 206. By contrast, at the first arc point 260 and the second arc point 262, the rotatable blade 210 may be rotationally engaged with the drum 206 (e.g., in contact with a raised or protruding portion of the drum 206, such as at the wall 208 or a bottom surface thereof). The drum 206 may move (e.g., rotate about the central axis X) relative to the rotatable blade 210 between an agitator position (e.g., FIG. 5) and a crusher position.

Although the maximum circumferential length or distance 264 between the arc points 260, 262 and the corresponding rotatable blade 210 (e.g., at the endcap 256) may vary based on the proportions of the rest of the dispensing assembly 110, the distance 264 may be defined as a spacing angle about the central axis X. In some embodiments, the spacing angle is greater than or equal to 10°. In additional or alternative embodiments, the spacing angle is less than or equal to 170°. Thus, the rotatable drum 206 may be forced to rotate (e.g., in the clockwise or counterclockwise circumferential direction) across the maximum circumferential length 264 (e.g., between 10° and 170°) between the agitator position and the crusher position.

In the crusher position, a portion of the rotatable blade 210, such as one side of the endcap 256, is engaged with the drum 206 at the first arc point 260 (e.g., directly or indirectly through a portion of an agitator bridge 230A or 230B). Moreover, in the crusher position, the rotatable blade 210 is circumferentially spaced apart from the second arc point 262. Thus, rotation of the drum 206 (e.g., clockwise) may be transferred to the rotatable blade 210. By contrast, in the agitator position, a portion of the rotatable blade 210, such as an opposite side of the endcap 256, is engaged with the drum 206 at the second arc point 262 (e.g., directly or indirectly through a portion of an agitator bridge 230A or 230B). Moreover, in the agitator position, the rotatable blade 210 is circumferentially spaced apart from the first arc point 260. Thus, rotation of the drum 206 (e.g., counterclockwise) may be transferred to the rotatable blade 210. Between the crusher position and the agitator position, the drum 206 may rotate relative to the rotatable blade 210, which in turn may remain stationary.

Figure 5:
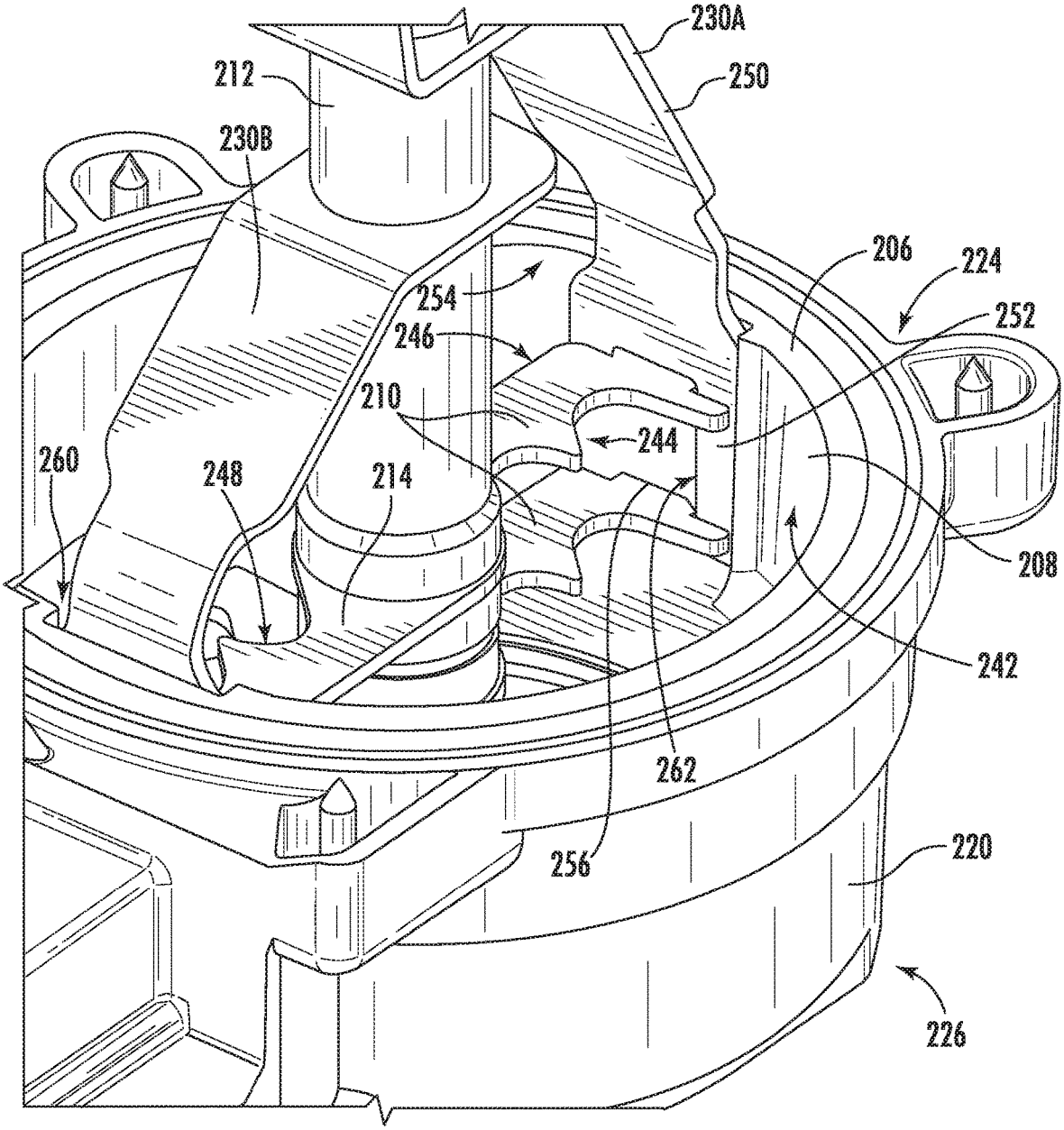
FIG. 5 provides a perspective view of a portion of an ice dispensing assembly according to exemplary embodiments of the present disclosure.
Figure 6:
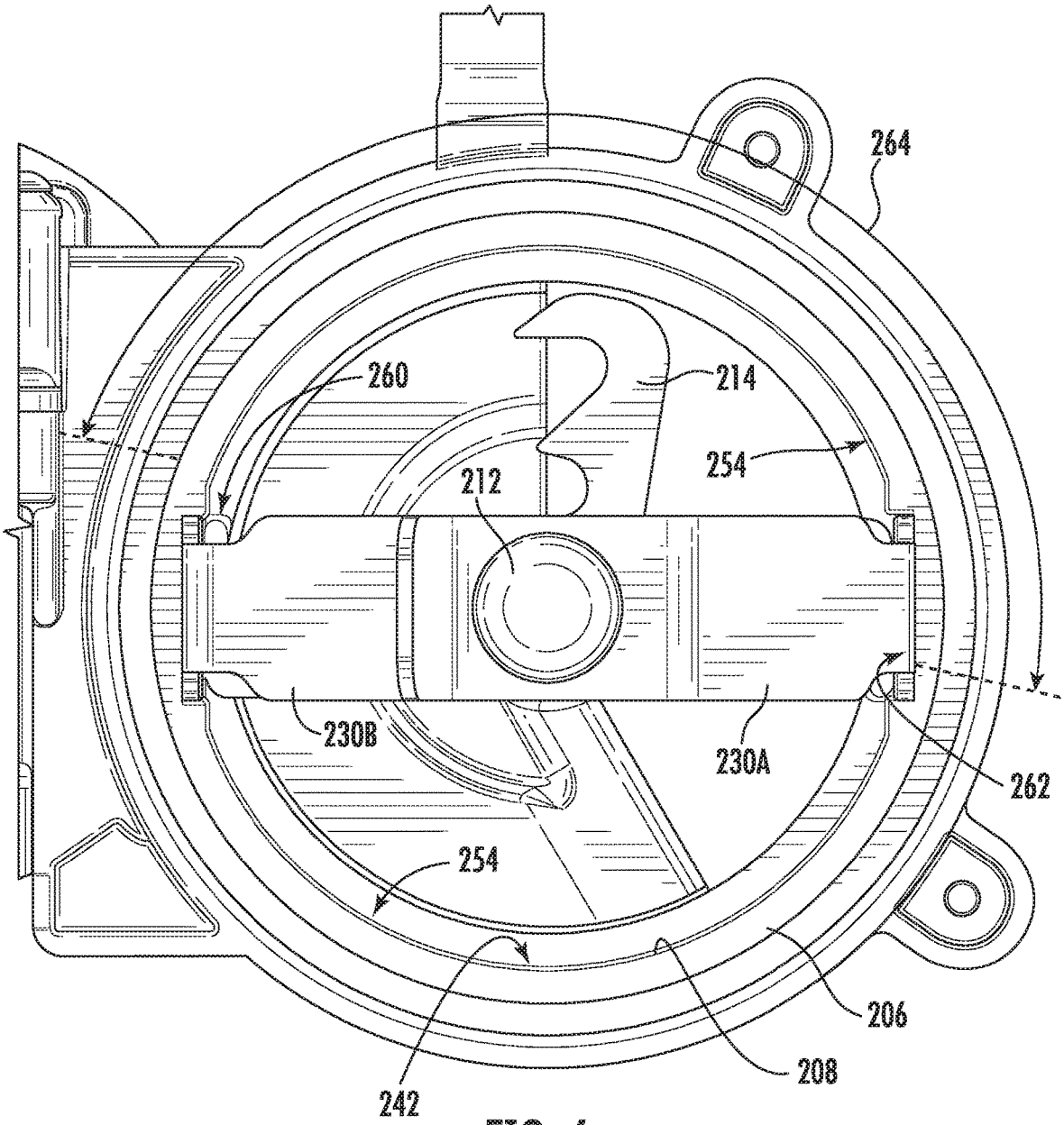
FIG. 6 provides a top perspective view of a portion of an ice dispensing assembly according to exemplary embodiments of the present disclosure.
Figure 8:
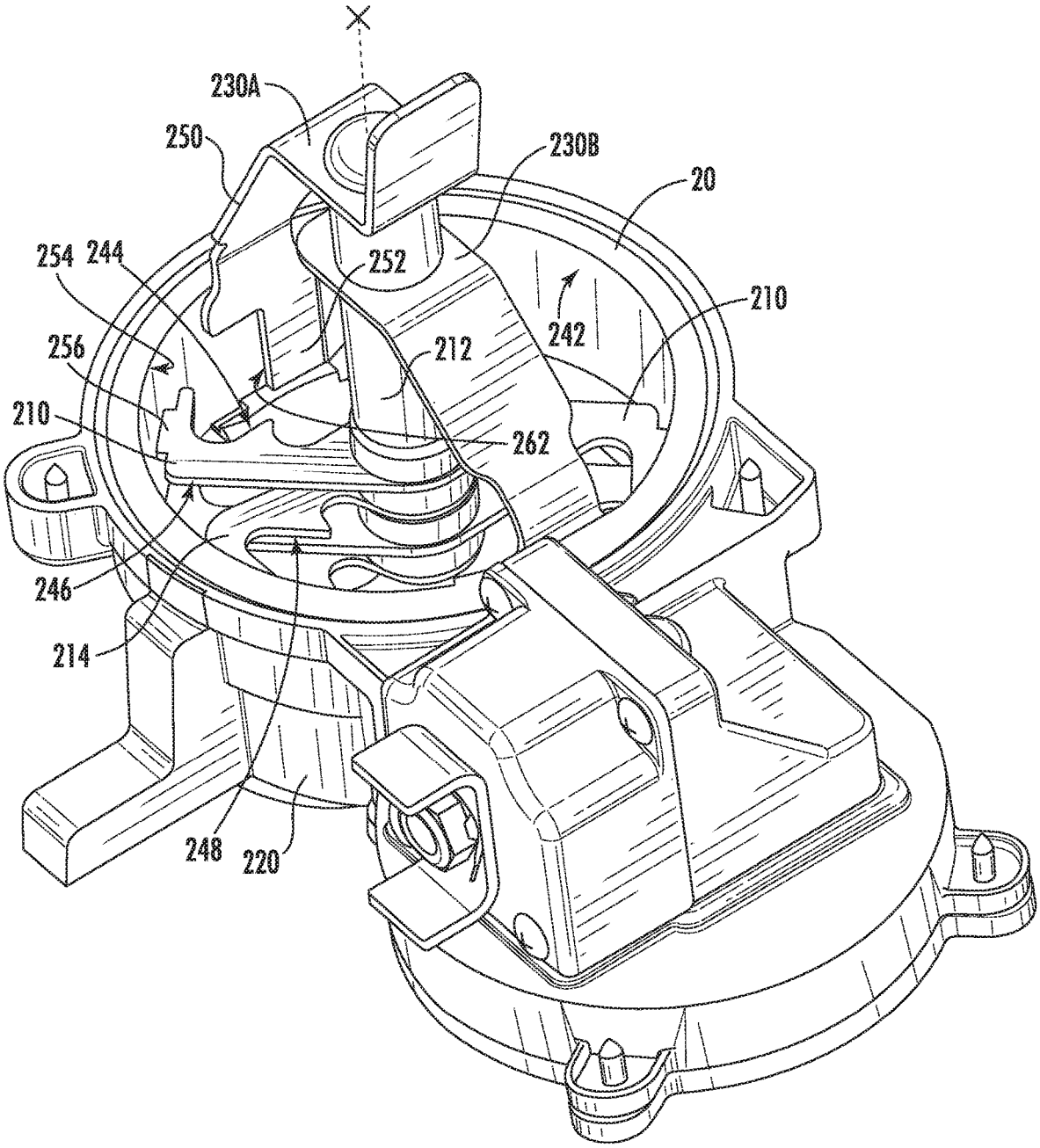
FIG. 8 provides a perspective view of a portion of an ice dispensing assembly according to exemplary embodiments of the present disclosure.

In certain embodiments, the first arc point 260 and second arc point 262 of a single inner channel 254 are defined by separate agitator bridges 230A, 230B. For instance, as illustrated in FIGS. 5, 6, and 8, a first agitator bridge 230A defines the first arc point 260 while a second agitator bridge 230B defines the second arc point 262.

Figure 9:
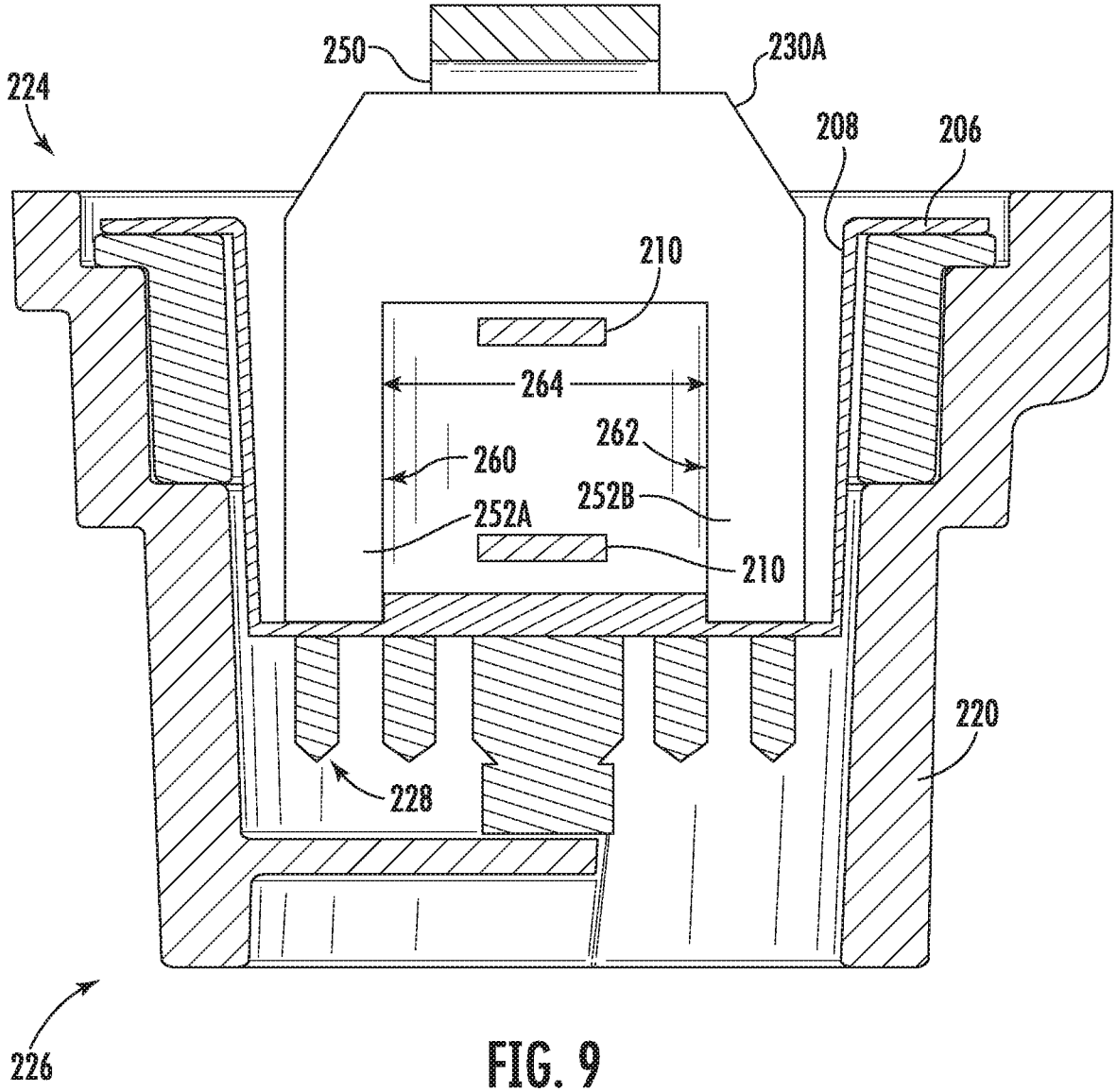
FIG. 9 provides a sectional view of a portion of an ice dispensing assembly according to exemplary embodiments of the present disclosure.

In alternative embodiments, the first arc point 260 and second arc point 262 of a single inner channel 254 are defined by a single agitator bridge 230A or 230B. For instance, as illustrated in FIG. 9, a single agitator bridge 230A or 230B may include a first internal tab 252A and a second internal tab 252B that is circumferentially spaced apart from the first internal tab 252A. Both the first and the second internal tab 252B may extend (e.g., axially and in parallel) from a common corresponding upper body 250. The endcap 256 of a rotatable blade 210 may be bounded between the first and the second internal tab 252B. The first internal tab 252A may define the first arc point 260 while the second internal tab 252B defines the second arc point 262.

Figure 3:
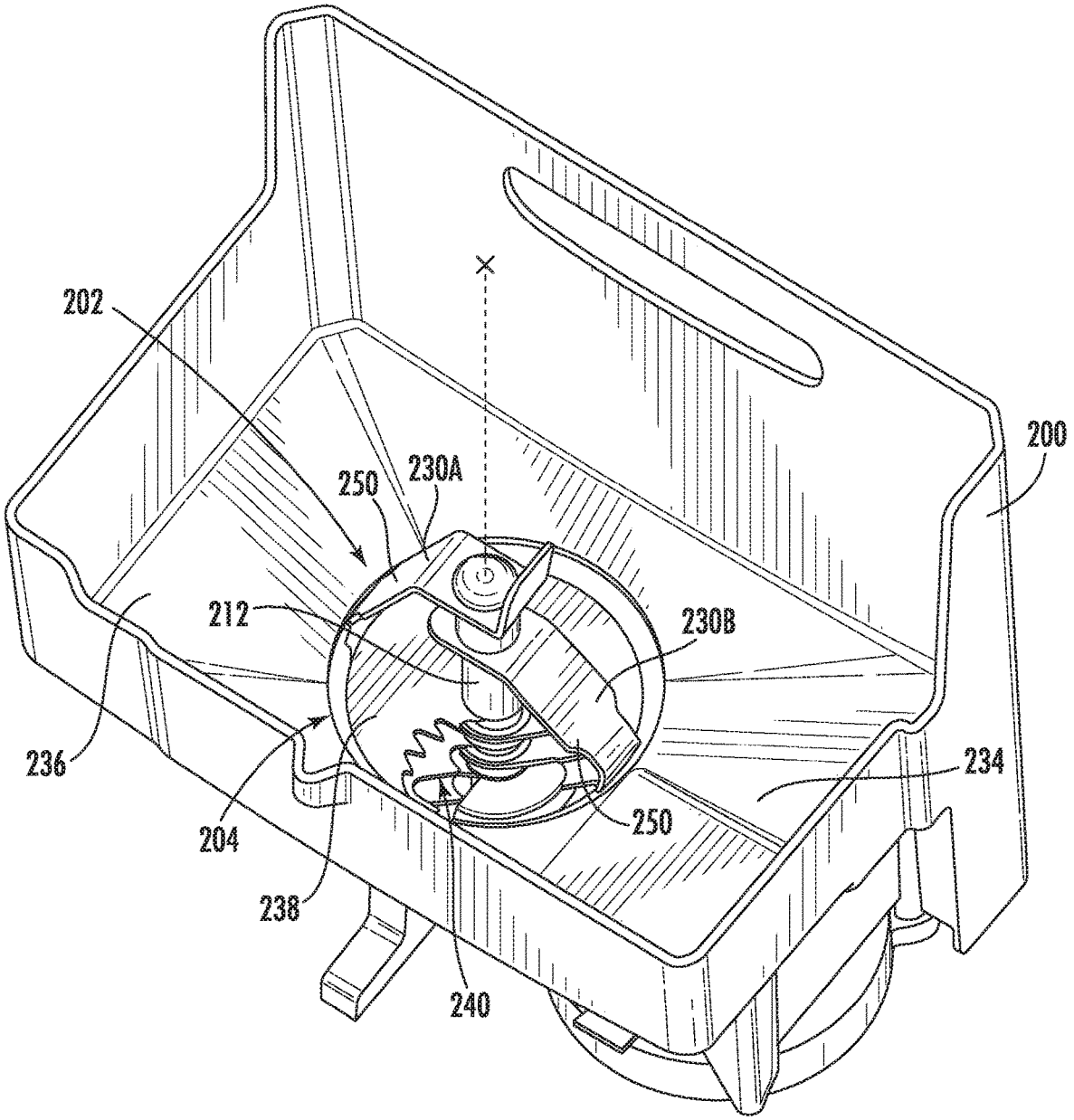
FIG. 3 provides a perspective view of an ice storage container and dispenser according to exemplary embodiments of the present disclosure, wherein a portion of the storage container is removed for clarity.
Figure 4:
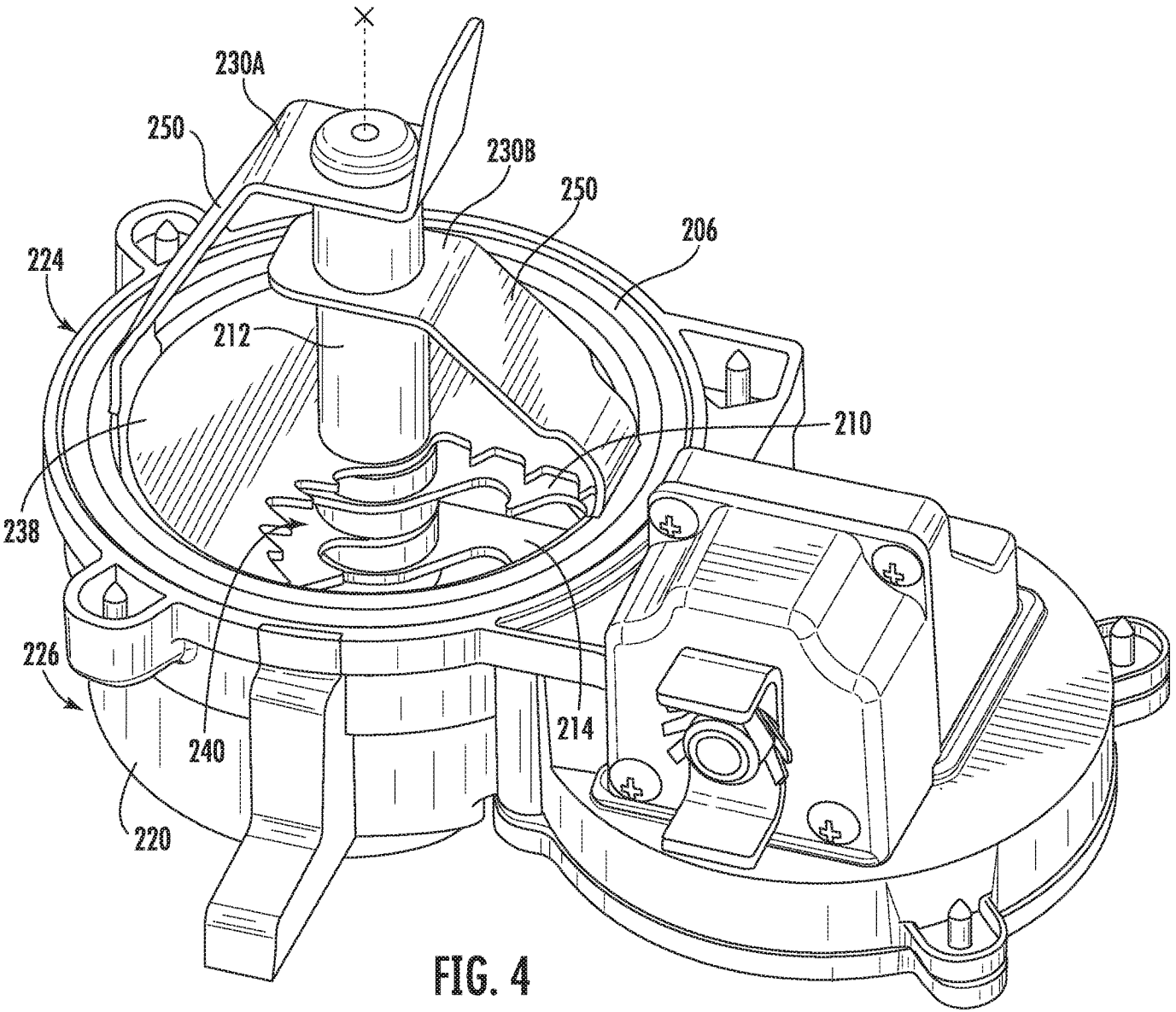
FIG. 4 provides a perspective view of a portion of an ice dispensing assembly according to exemplary embodiments of the present disclosure.

As shown in FIGS. 3 and 4, cover 238 is positioned or disposed across, at least a portion of drum 206 (e.g., at the top end 224). In some embodiments, cover 238 is attached to pin 212 and not directly to drum 206. During use, cover 238 may remain stationary such that it does not rotate with drum 206. Cover 238 may also define a first aperture 240 through which ice must pass in order to travel from container 200 and through drum 206.

Figure 7:
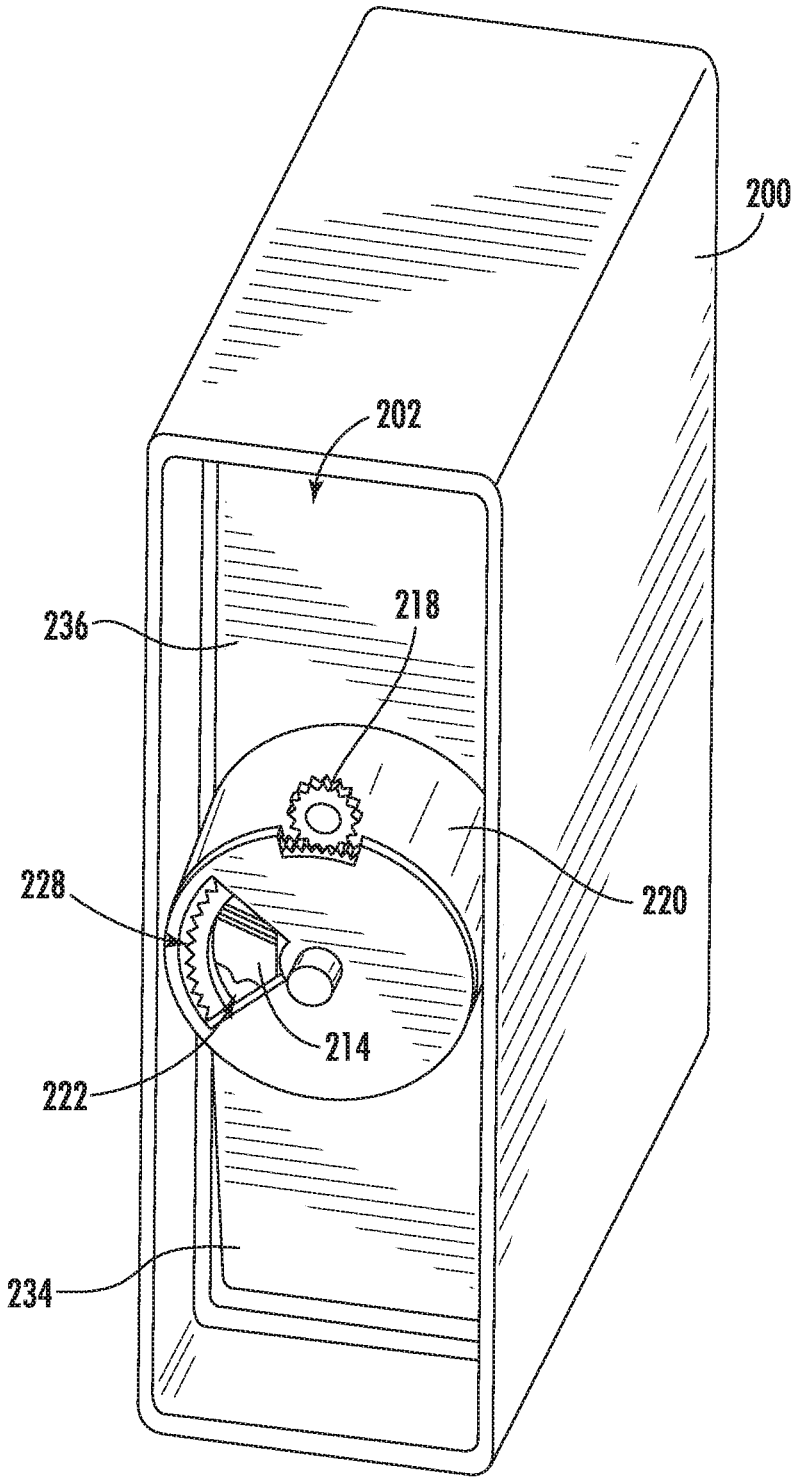
FIG. 7 provides a bottom perspective view of an ice storage container and dispenser according to exemplary embodiments of the present disclosure, wherein a portion of the storage container is removed for clarity.

As illustrated in FIG. 7, the bottom end 226 of drum 206 may be formed with a plurality of gear teeth 228 that are positioned or disposed along a circumference of drum 206. A motor 216 (FIG. 2) is provided in mechanical communication with drum 206 (e.g., through one or more gear teeth 228, gear 218, keys, gear trains, etc. connected with motor 216). By way of example, motor 216 may be selectively operated by the controller 190 discussed above. Based on whether whole or crushed ice has been selected by a user of the appliance, the controller 190 can direct the rotation of the gear 218 by motor 216 and thereby control the direction of rotation of drum 206 to provide ice as selected. The motor and gear configuration of FIG. 7 is provided by way of example only; multiple other configurations for rotating drum 206 may be used as well.

In some embodiments, bottom end 226 of housing 220 also includes a second aperture 222 through which ice must pass in order to exit drum 206. The position of first aperture 240 and second aperture 222 may be offset with respect to the central axis X. In other words, first aperture 240 may not be located directly over second aperture 222 along the vertical direction V or relative to the central axis X. In this way, ice entering into drum 206 may be forced to make contact with blades 210 and 214 as the ice travels through drum 206.

By way of example of the ice dispensing operation of ice dispensing assembly 110, ice may be dropped into container 200 from the ice maker through opening 162 in insulated housing 142. Sloped walls 234 and 236 may help direct ice toward first aperture 240 so that ice may move through aperture 240 and opening 204 and into drum 206 under the force of gravity. Depending upon whether the user has selected crushed or whole ice using interface panel 136, a controller 190 can determine the direction of rotation of drum 206. Such rotation could be activated based upon, for instance, the depressing of paddle 134 by a user such that a request for ice is received by the controller 190. The controller 190 could then activate motor 216 appropriately.

The rotation of drum 206 by activation of motor 216 may also rotate the agitator bridges 230 so as to stir ice in container 200 (e.g., once the drum 206 has reached to agitator position or the crusher position). If the user has selected crushed ice, drum 206 is rotated so that the movement of rotatable blades 210 relative to the non-rotating blades 214 will pinch and then crush ice between the cutting edges 244 and 248. As ice travels vertically down through drum 206, multiple blades 210 and 214 can be provided as shown so as to help ensure that the ice is crushed sufficiently. Alternatively, if the user has selected whole or non-crushed ice, drum 206 is rotated so that the movement of rotatable blades 210 relative to stationary blades 214 will avoid crushing ice therebetween. After travelling down drum 206, ice can exit through second aperture 222 and pass through discharge outlet 132 into, for example, the user's cup or glass.

Figure 10:
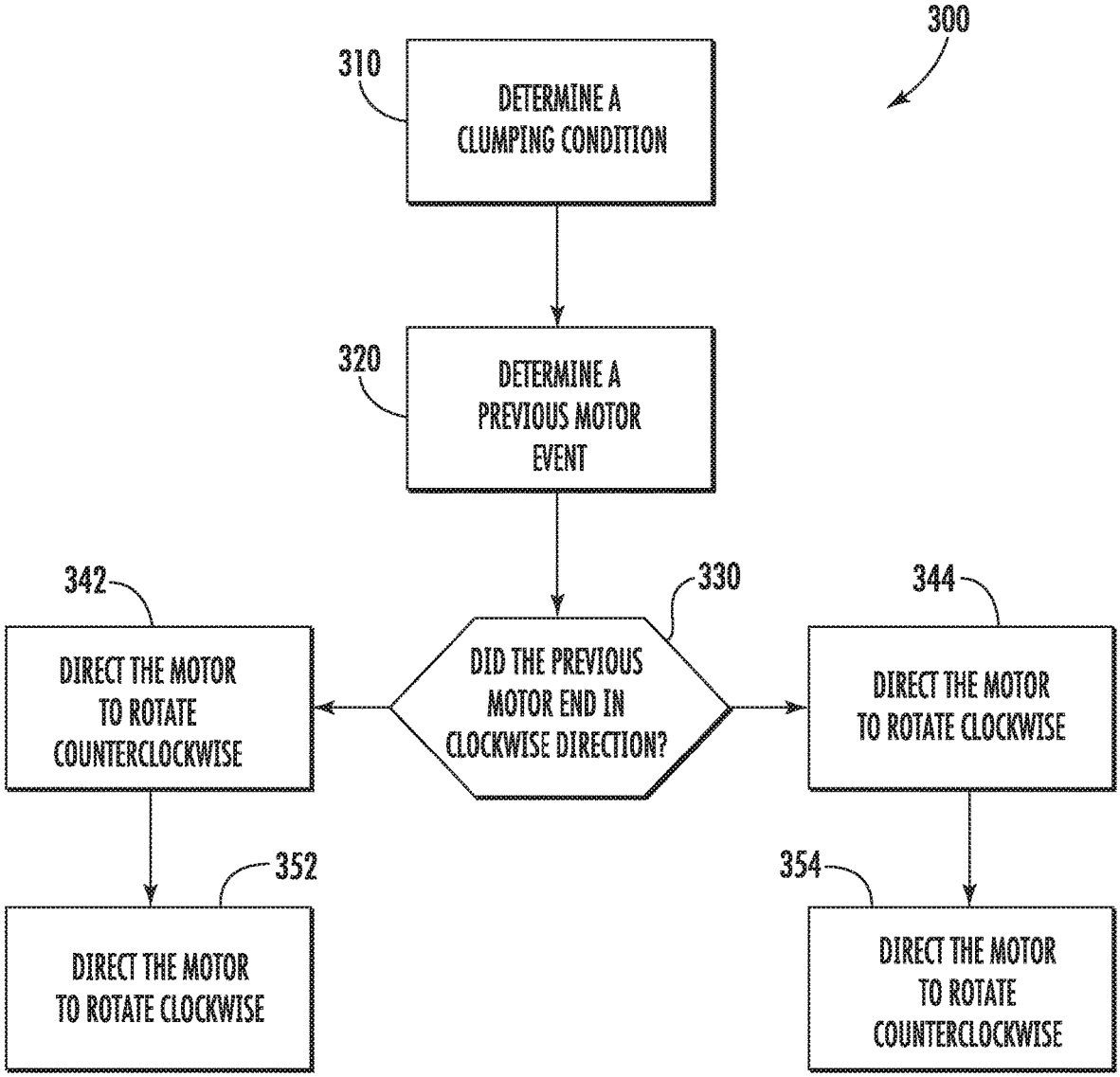
FIG. 10 provides a flow chart illustrating a method of operating an ice dispensing assembly according to exemplary embodiments of the present disclosure.

In some embodiments, the controller 190 may direct the drum 206 (e.g., via the motor 216) to initiate an ice treatment cycle. Such an ice treatment cycle may advantageously agitate ice within storage container 200 without forcing any ice to or through second aperture 222. For instance, turning now to FIG. 10, a flow chart is provided of a method 300 according to exemplary embodiments of the present disclosure. Generally, the method 300 provides a method of operating a refrigerator appliance (e.g., as part of an ice treatment cycle), such as refrigerator appliance 100 (FIG. 1) that include an ice dispensing assembly 110, as described above. The method 300 can be performed, for instance, by the controller 190. For example, controller 190 may, as discussed, be in electrical communication with motor 216, sensors 192, 194, or user control panel 136. During operations, controller 190 may send signals to and receive signals from motor 216, sensors 192, 194, or user control panel 136. Controller 190 may further be in operative communication to other suitable components of the refrigerator appliance 100 to facilitate operation of the refrigerator appliance 100 generally.

At 310, the method 300 includes determining a clumping condition. Generally, the clumping condition may indicate a condition within the dispensing assembly or container in which sublimation or refreezing of ice is likely.

In certain embodiments, the clumping condition may include time from a previous motor event. In other words, the method 300 may include determining a predetermined timespan (e.g., in minutes or hours) has expired since the last (i.e., most recent prior) motor event. Optionally, each motor event may prompt a timer configured to measure the predetermined timespan and, for instance, transmit or generate a signal indicating the moment at which the predetermined timespan expires. If a new motor event occurs before expiration of the predetermined timespan, the timer may be restarted. The motor event may generally correspond to activation of the motor and rotation of the drum, such as would occur during a dispensing cycle, crushing cycle, or previous ice treatment cycle.

In additional or alternative embodiments, the clumping condition includes receiving a sensor signal (e.g., transmitted from the water sensor or the temperature sensor, as described above). As an example, a signal may be received by the controller in response to a predetermined volume of water being detected within the dispensing assembly, such as in the container. As an additional or alternative example, a signal may be received by the controller in response to a predetermined temperature (e.g., maximum temperature limit) being detected at the dispensing assembly, such as within the housing thereof. Based on one or more received sensor signals, the controller may determine sublimation is possible or likely.

The subsequent steps (e.g., one or all of 320, 330, 342, 344, 352, or 354) may proceed in response to determining the clumping condition at 310.

At 320, the method 300 includes determining a prior motor event. In particular, 320 may include determining what direction the motor rotated most recently. In other words, it may be determined whether the motor last rotated the drum in the clockwise circumferential direction or the counterclockwise circumferential direction. Optionally, 320 may include determining whether the motor last rotated as part of an agitator cycle, crusher cycle, or ice treatment cycle. Additionally or alternatively, 320 may include determining what position the drum is in (e.g., the agitator position, the crusher position, etc.).

At 330, the method 300 includes selecting a circumferential direction of drum rotation based on the prior motor event at 320. From the selected direction, the rotatable drum may be rotated on a limited path between the crusher position and the agitator position. Specifically, if the prior motor event ended or included (e.g., as a final motion) rotating the drum in the first or clockwise circumferential direction, the method 300 may proceed to 342. By contrast, if the prior motor ended or included (e.g., as a final motion) rotating the drum in the second or counterclockwise circumferential direction, the method 300 may proceed to 344.

At 342, the method 300 includes rotating the rotatable drum in the second or counterclockwise circumferential direction. Specifically, at 342, the motor is activated to rotate the drum counterclockwise from the crusher position. Optionally, the drum may be rotated to the agitator position. In some such embodiments, rotation of the drum is halted at or prior to the agitator position. Thus, the drum may be prevented from rotating, moving, or advancing the rotatable blades. Upon reaching the agitator position or, alternatively, prior to reaching the agitator position, the method 300 may proceed to 352.

At 352, the method 300 includes rotating the rotatable drum in the first or clockwise circumferential direction. In some embodiments, at 352, the motor is activated to rotate the drum clockwise to the agitator position. Thus, for example, the drum and rotatable blade may generally return to the same relative position that existed immediately prior to 310.

Returning to 330, if the first or clockwise direction is selected, the method may proceed to 344. At 344, the method 300 includes rotating the rotatable drum in the first or clockwise circumferential direction. Specifically, at 344, the motor is activated to rotate the drum clockwise from the agitator position. Optionally, the drum may be rotated to the crusher position. In some such embodiments, rotation of the drum is halted at or prior to the crusher position. Thus, the drum may be prevented from rotating, moving, or advancing the rotatable blades. Upon reaching the crusher position or, alternatively, prior to reaching the crusher position, the method 300 may proceed to 354.

At 354, the method 300 includes rotating the rotatable drum in the second or counterclockwise circumferential direction. In some embodiments, at 354, the motor is activated to rotate the drum counterclockwise to the crusher position. Thus, for example, the drum and rotatable blade may generally return to the same relative position that existed immediately prior to 310.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice dispensing assembly for an appliance, the ice dispensing assembly comprising:

a container for receiving ice, the container having a bottom defining an opening for passing ice from the container;

a rotatable drum defining a central axis and positioned below the container at the opening defined by the bottom of the container, the rotatable drum having a wall, the rotatable drum defining an inner channel extending circumferentially along an inner surface of the wall from a first arc point to a second arc point;

a motor in mechanical communication with the rotatable drum and configured to selectively cause the rotatable drum to rotate about the central axis;

an agitator bridge extending above the wall in rotational engagement with the rotatable drum; and a rotatable blade housed within the rotatable drum below the agitator bridge, the rotatable blade being in selective rotational engagement with the rotatable drum, the rotatable blade being circumferentially bounded by the first arc point and the second arc point, wherein the rotatable drum is movable between a crusher position and an agitator position, the crusher position comprising the rotatable blade in engagement with the rotatable drum at the first arc point while being circumferentially spaced apart from the second arc point, and the agitator position comprising the rotatable blade in engagement with the rotatable drum at the second arc point while being circumferentially spaced apart from the first arc point.

2. The ice dispensing assembly of claim 1, further comprising a stationary blade housed within the rotatable drum below the agitator bridge, the stationary blade being rotationally fixed within the rotatable drum such that the stationary blade is non-rotatable about the central axis.

3. The ice dispensing assembly of claim 1, wherein the agitator bridge is a first agitator bridge, and wherein the ice dispensing assembly further comprises a second agitator bridge extending above the wall in rotational engagement with the rotatable drum, the second agitator bridge being circumferentially spaced apart from the first agitator bridge about the central axis.

4. The ice dispensing assembly of claim 1, wherein the agitator bridge comprises an upper body and a first internal tab extending axially from the upper body along an inner surface of the rotatable drum to define the second arc point.

5. The ice dispensing assembly of claim 4, wherein the agitator bridge is a first agitator bridge, and wherein the ice dispensing assembly further comprises a second agitator bridge extending above the wall in rotational engagement with the rotatable drum, the second agitator bridge comprising an upper body and a first internal tab, the first internal tab of the second agitator bridge being circumferentially spaced apart from the first internal tab of the first agitator bridge about the central axis to define the second arc point.

6. The ice dispensing assembly of claim 4, wherein the agitator bridge further comprises a second internal tab extending axially from the upper body along an inner surface of the rotatable drum to define the second arc point, the second internal tab being circumferentially spaced apart from the first internal tab about the central axis.

7. The ice dispensing assembly of claim 1, wherein the rotatable blade comprises a plurality of teeth on one circumferential edge of the rotatable blade, and wherein the rotatable blade further comprises a flat edge on an opposite circumferential edge from the plurality of teeth.

8. The ice dispensing assembly of claim 1, further comprising a pin extending along the central axis through the rotatable drum, the agitator bridge being joined to the pin at the central axis.

9. The ice dispensing assembly of claim 1, further comprising a controller in electrical communication with the motor, wherein the controller is configured to initiate an ice treatment cycle comprising determining a clumping condition, and directing the motor to rotate the rotatable drum on a limited path between the crusher position and the agitator position in response to determining the clumping condition.

10. The ice dispensing assembly of claim 9, wherein the clumping condition comprises time from a previous motor event.

11. The ice dispensing assembly of claim 9, wherein the clumping condition comprises receiving a sensor signal.

12. The ice dispensing assembly of claim 9, wherein the ice treatment cycle further comprises determining a prior motor event, and selecting a circumferential direction of drum rotation based on the prior motor event.

13. The ice dispensing assembly of claim 12, wherein the prior motor event comprises rotating the rotatable drum in a first circumferential direction, and wherein selecting the circumferential direction comprises selecting a second circumferential direction opposite the first circumferential direction.

14. A method of operating an ice dispensing assembly comprising a container for receiving ice, a rotatable drum positioned below the container and defining an inner channel extending circumferentially from a first arc point to a second arc point, a motor in mechanical communication with the rotatable drum, an agitator bridge in rotational engagement with the rotatable drum, and a rotatable blade housed within the rotatable drum below the agitator bridge, the rotatable blade being in selective rotational engagement with the rotatable drum, the rotatable blade being circumferentially bounded by the first arc point and the second arc point, the method comprising:

determining a clumping condition within the container; and directing the motor to rotate the rotatable drum on a limited path between a crusher position and an agitator position in response to determining the clumping condition, the crusher position comprising the rotatable blade in engagement with the rotatable drum at the first arc point while being circumferentially spaced apart from the second arc point, and the agitator position comprising the rotatable blade in engagement with the rotatable drum at the second arc point while being circumferentially spaced apart from the first arc point.

15. The method of claim 14, wherein the clumping condition comprises time from a previous motor event.

16. The method of claim 14, wherein the clumping condition comprises receiving a sensor signal.

17. The method of claim 14, wherein the ice treatment cycle further comprises determining a prior motor event, and selecting a circumferential direction of drum rotation based on the prior motor event.

18. The method of claim 17, wherein the prior motor event comprises rotating the rotatable drum in a first circumferential direction, and wherein selecting the circumferential direction comprises selecting a second circumferential direction opposite the first circumferential direction.

* * * * *